US009429354B2

(12) United States Patent
Ha et al.

(10) Patent No.: US 9,429,354 B2
(45) Date of Patent: Aug. 30, 2016

(54) REFRIGERATOR

(71) Applicant: Samsung Electronics Co., Ltd., Suwon-si (KR)

(72) Inventors: Joo-Young Ha, Suwon-si (KR); Deul Re Min, Yongin-si (KR); Mi-Sun Park, Gwangju-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/821,346

(22) Filed: Aug. 7, 2015

(65) Prior Publication Data

US 2016/0040922 A1 Feb. 11, 2016

(30) Foreign Application Priority Data

Aug. 7, 2014 (KR) ..... 10-2014-0101984

(51) Int. Cl.
*F25D 23/00* (2006.01)
*F25D 25/02* (2006.01)
*F25D 23/08* (2006.01)

(52) U.S. Cl.
CPC ..... *F25D 23/006* (2013.01); *F25D 25/025* (2013.01); *F25D 23/087* (2013.01); *F25D 2201/00* (2013.01)

(58) Field of Classification Search
CPC .... F25D 25/005; F25D 25/02; F25D 25/024; F25D 25/025; F25D 2325/022
USPC ..... 312/404, 408
See application file for complete search history.

(56) References Cited

U.S. PATENT DOCUMENTS 4,729,613 A * 3/1988 Tromble ..... F25D 25/021 211/153
5,273,354 A * 12/1993 Herrmann ..... A47B 96/025 312/408
8,414,095 B2 * 4/2013 Stewart ..... F25D 25/024 108/108
9,140,483 B2 * 9/2015 Park ..... F25D 25/025
2007/0262686 A1 11/2007 Ji
2008/0191589 A1 * 8/2008 Dorner ..... A47B 88/044 312/116
2010/0102693 A1 * 4/2010 Driver ..... A47B 95/043 312/408

(Continued)

FOREIGN PATENT DOCUMENTS

EP 2333469 A2 6/2011
EP 2333469 A3 6/2011

(Continued)

OTHER PUBLICATIONS

Communication with European Search Report dated Dec. 15, 2015 corresponding to European Patent Application No. EP 15179919.

*Primary Examiner* — Daniel Rohrhoff
(74) *Attorney, Agent, or Firm* — McAndrews Held & Malloy, Ltd.

(57) ABSTRACT

Disclosed herein is a refrigerator including a structure to improve sealability of a storage compartment and in turn, help to improve the preservability of food. The refrigerator may include a storage compartment including a front side provided to be opened, a storage member provided inside the storage compartment to be put into or taken out, a storage member cover coupled to the storage member to selectively open or close a storage space of the storage member, and a rail which guides movement of the storage member cover, and includes a step to control a sealing state of the storage space of the storage member according to the movement of the storage member cover.

21 Claims, 12 Drawing Sheets

(56) References Cited

U.S. PATENT DOCUMENTS

| | | | | |
|---|---|---|---|---|
| 2012/0036875 | A1* | 2/2012 | Yun | F25D 25/005 62/126 |
| 2013/0257254 | A1* | 10/2013 | Austin | F25D 25/025 312/404 |
| 2013/0270986 | A1* | 10/2013 | Min | B65D 25/22 312/330.1 |

FOREIGN PATENT DOCUMENTS

| | | | |
|---|---|---|---|
| KR | 1020010017917 | | 3/2001 |
| KR | 1020010029614 | | 4/2001 |
| KR | 1020030026103 | | 3/2003 |
| KR | 1020040061384 | | 7/2004 |
| KR | 1020060032439 | | 4/2006 |
| KR | 1020060115008 | | 11/2006 |
| KR | 1020070034335 | | 3/2007 |
| KR | 1020100065459 | | 6/2010 |
| KR | 1020100065485 | | 6/2010 |
| KR | 1020100114666 | | 10/2010 |
| KR | 1020110067928 | | 6/2011 |
| KR | 1020130116741 | | 6/2011 |
| WO | 2009125922 | A2 | 10/2009 |
| WO | 2009125922 | A3 | 10/2009 |

* cited by examiner

REFRIGERATOR

CROSS-REFERENCE TO RELATED APPLICATION

This application claims the benefit of Korean Patent Application No. 2014-0101984, filed on Aug. 7, 2014 in the Korean Intellectual Property Office, the disclosure of which is incorporated herein by reference.

BACKGROUND

Embodiments of the present invention relate to a refrigerator having an improved structure to improve preservability of food.

In general, refrigerators are home appliances that have storage compartments to store food and cold air supplying units to supply cold air to the storage compartments, which helps to store the food freshly.

The type of a refrigerator may be classified by storage compartment and door shape. Specifically, a refrigerator, in which storage compartments are vertically partitioned by horizontal partitions, may be classified into a top mounted freezer (TMF). A TMF-type has a freezer compartment formed at an upper portion and refrigerator compartment formed at a lower portion thereof. A bottom mounted freezer (BMF) type has a freezer compartment formed at a lower portion and a refrigerator compartment formed at an upper portion thereof.

In addition, a refrigerator may be classified as a side by side (SBS) type. A SBS-type refrigerator has a storage compartment horizontally partitioned by a vertical partition, where a freezer compartment is formed at one side thereof and a refrigerator compartment is formed at the other side thereof. A French door refrigerator (FDR) type has storage compartments vertically partitioned by horizontal partitions, where a refrigerator compartment is formed at an upper portion and a freezer compartment is formed at a lower portion. Typically, the refrigerator compartment at the upper portion of the FDR-type refrigerator are opened or closed by a pair of doors.

Storage members for storing food may be installed inside storage compartments of refrigerators. The storage members may be configured to be put into closed state or taken out in an open state.

In general, when food is required to be kept fresh, sealability improvement of the storage members is required to maintain appropriate humidity. When the appropriate humidity is not maintained, the food inside the storage members loses its moisture and may lose its freshness. In addition, when the smell of food stored inside storage compartments and the smell of food stored inside a storage member are mixed, inherent flavor of the food may be lost.

SUMMARY

It is an aspect of embodiments of the present invention to provide a refrigerator which allows an improved structure to improve sealability of a storage member.

It is another aspect of embodiments of the present invention to provide a refrigerator which allows an improved structure to improve water capturability of a storage member.

In accordance with one aspect of embodiments of the present invention, a refrigerator includes a storage compartment including a front side provided to be opened, a storage member provided inside the storage compartment to be put into or taken out toward the front of the storage compartment, a storage member cover coupled to the storage member to selectively open or close a storage space of the storage member, and a rail which guides movement of the storage member cover, and includes a step to control a sealing state of the storage space of the storage member according to the movement of the storage member cover.

In accordance with one aspect of the present invention, the refrigerator may further include a sealing member provided between the storage member and the storage member cover to improve sealability of the storage space of the storage member. The sealing member may be coupled to the storage member cover. The sealing member may include a pleat portion having a plurality of pleats and coupled to the storage member cover, and an adhesion portion which is connected to the pleat portion and adheres to the storage member to be separable according to the movement of the storage member cover.

The adhesion portion may be connected to the pleat portion to be inclined toward an outside of the sealing member with respect to a coupling direction of the storage member cover. The rail may be provided on a side surface of the storage member to extend in a front and rear direction of the storage compartment.

A roller which moves along the rail may be coupled to the storage member cover, and the rail may include a first section provided toward a front of the storage compartment, and a second section which is connected to the first section toward a rear of the storage compartment and positioned at an upper level than the first section in a coupling direction of the storage member cover.

The storage member cover may adhere to the storage member to seal the storage space of the storage member when the roller is positioned at the first section. The storage member cover may be spaced apart from the storage member to open the storage space of the storage member when the roller is positioned at the second section.

In accordance with another aspect of embodiments of the present invention, the refrigerator may further include a sealing member coupled to the storage member cover to improve sealability of the storage space of the storage member, and the sealing member may adhere to the storage member downward in the coupling direction of the storage member cover to seal the storage space of the storage member when the roller is positioned at the first section.

The sealing member may be spaced apart from the storage member upward in the coupling direction of the storage member cover to prevent the sealing member from being abraded due to a contact with the storage member while the roller moves along the second section.

A stopper may be provided at the second section to restrict movement of the roller.

The rail may be integrally formed with the storage member to be positioned at a side surface of the storage member.

A water trapping pattern may be formed in a surface of the storage member cover facing the storage space of the storage member. The water trapping pattern may have a shape recessed upward in a coupling direction of the storage member cover.

The water trapping pattern may include a plurality of water trapping portions which are disposed to be spaced apart from each other and have a hexagonal column shape recessed upward in a coupling direction of the storage member cover.

In accordance with another aspect of embodiments of the present invention, a refrigerator includes a storage compartment including a front side provided to be opened, a storage member provided inside the storage compartment to be put into or taken out toward the front of the storage compartment, a storage member cover coupled to the storage member to selectively open or close a storage space of the storage member and including a water trapping pattern formed in a surface facing the storage space of the storage member, a sealing member provided between the storage member and the storage member cover to improve sealability of the storage space of the storage member, and a rail which guides movement of the storage member cover, and includes a slope to control a sealing state of the storage space of the storage member according to the movement of the storage member cover.

The water trapping pattern may have a shape recessed upward in a coupling direction of the storage member cover. The water trapping pattern may include a plurality of water trapping portions which are disposed to be spaced apart from each other.

A surface of the plurality of water trapping portions facing the storage space of the storage member may be formed in a hexagonal shape to have wide contact area with water drops trapped in the plurality of water trapping portions. The water trapping pattern may further include bridges which connect the plurality of water trapping portions each other and have a narrower width than the plurality of water trapping portions to prevent water drops trapped in the plurality of water trapping portions from being combined. Recessed degrees of the plurality of water trapping portions and the bridges may be different from each other.

A roller which moves along the rail may be coupled to the storage member cover, and the rail may include a first section provided toward a front of the storage compartment, a second section which is provided toward a rear of the storage compartment and positioned at an upper level than the first section in a coupling direction of the storage member cover, and a slope section connecting the first section and the second section.

The sealing member may be coupled to the storage member cover to face the storage space of the storage compartment, and the sealing member may adhere to the storage member to seal the storage space of the storage member when the roller is positioned at the first section. The sealing member may be spaced apart from the storage member upward in the coupling direction of the storage member cover to prevent the sealing member from being abraded due to a contact with the storage member while the roller moves along the second section.

BRIEF DESCRIPTION OF THE DRAWINGS

These and/or other aspects of embodiments of the invention will become apparent and more readily appreciated from the following description of the embodiments, taken in conjunction with the accompanying drawings of which.

DETAILED DESCRIPTION

Figure 1:
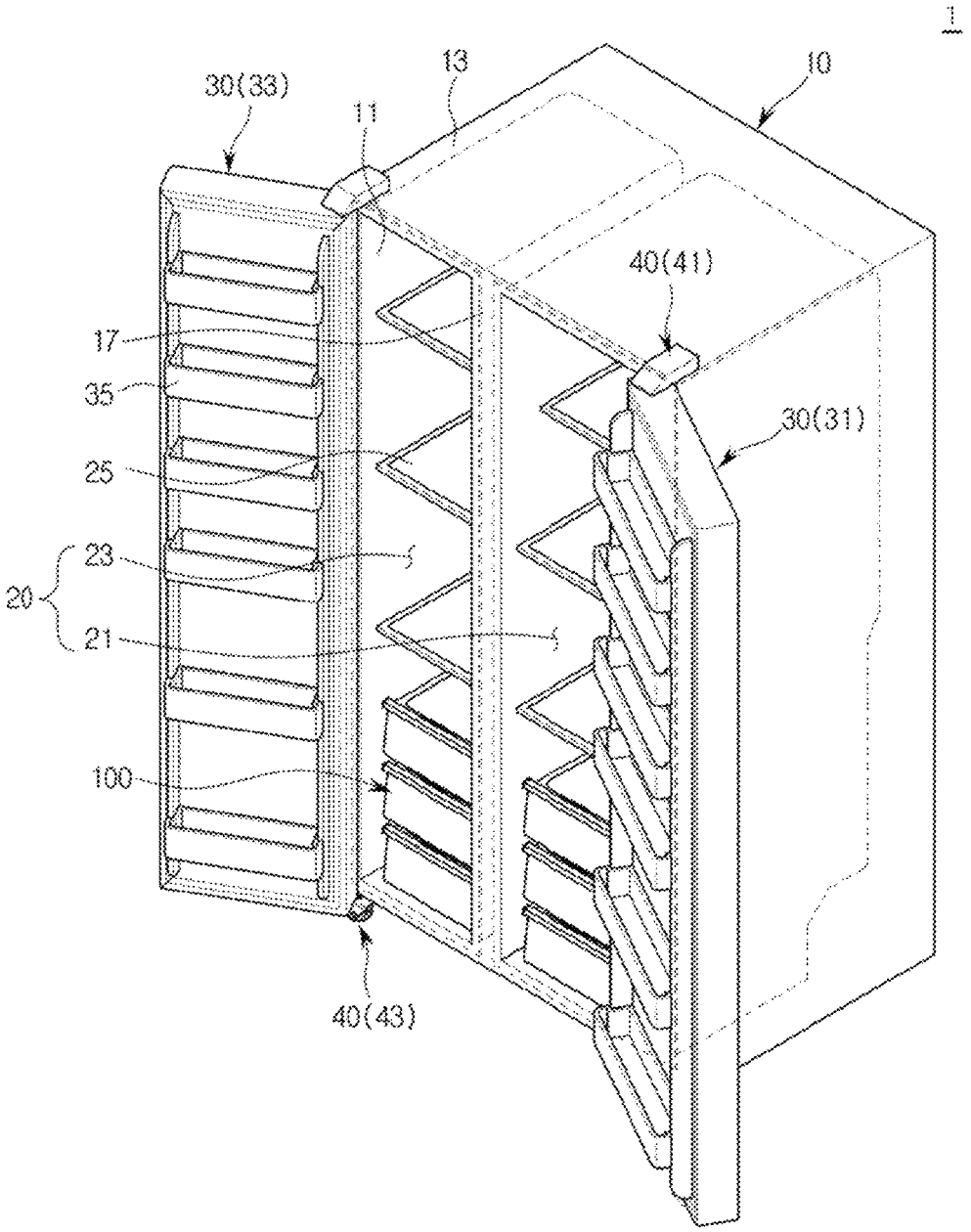
FIG. 1 is a perspective view illustrating a refrigerator according to one embodiment of the present invention.

Reference will now be made in detail to the embodiments of the present invention, examples of which are illustrated in the accompanying drawings, wherein like reference numerals refer to like elements throughout. Meanwhile, terms in the below description "front end" "back end" "upper portion" "lower portion" "upper end", "lower end" and the like are defined based on the drawings, and shapes and positions are not limited by the terms above.

Figure 2:
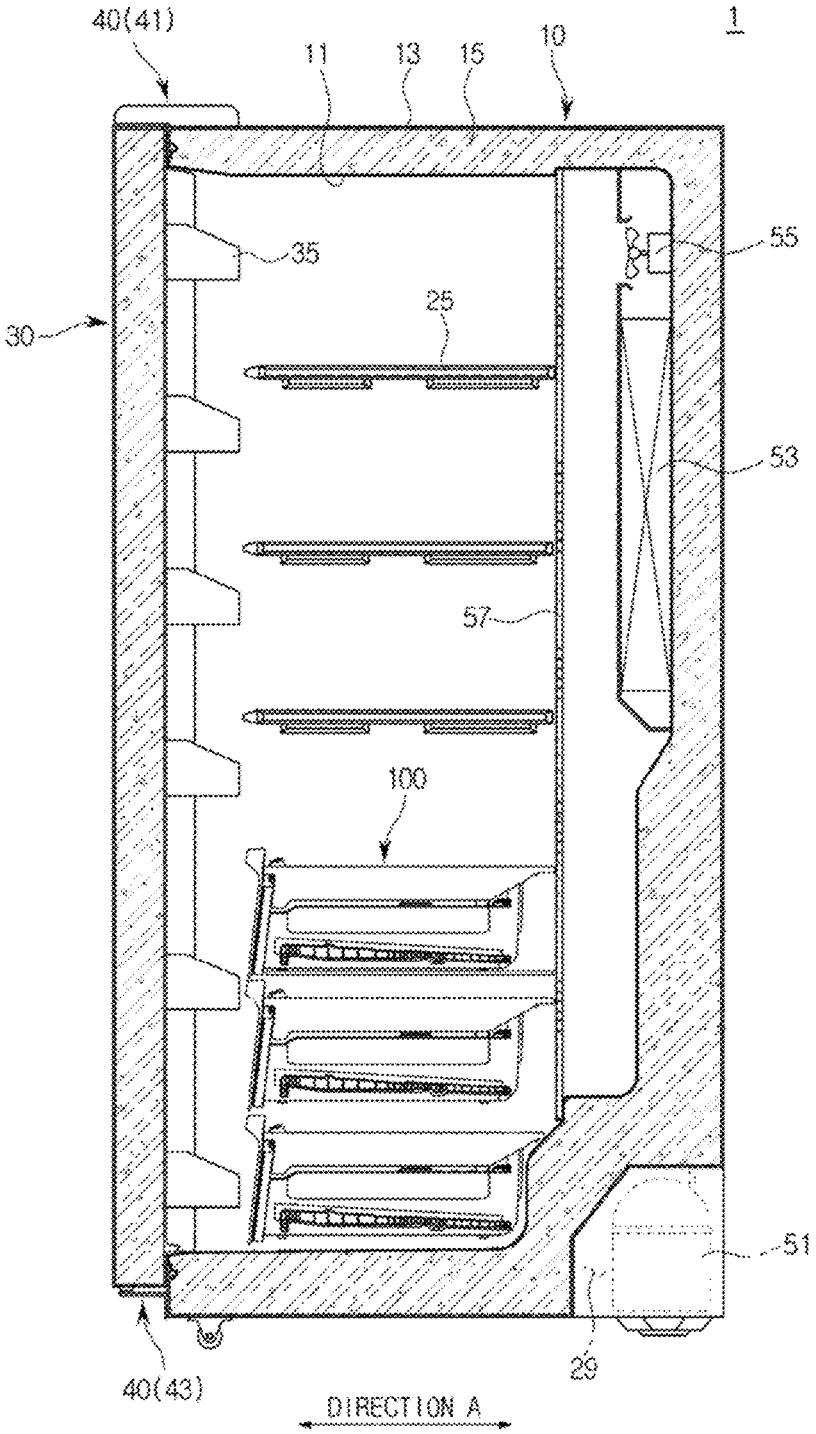
FIG. 2 is a cross-sectional view illustrating the refrigerator according to one embodiment of the present invention.

FIG. 1 is a perspective view illustrating a refrigerator according to one embodiment of the present invention, and FIG. 2 is a cross-sectional view illustrating the refrigerator according to one embodiment of the present invention.

As illustrated in FIGS. 1 and 2, a refrigerator 1 may include a main body 10 forming an exterior, a storage compartment 20 provided inside the main body 10 and having an opened front side, doors 30 pivotably coupled to the main body 10 to open and close the opened front side of the storage compartment 20, and hinge modules 40 disposed for the doors 30 to be rotatably coupled to the main body 10. Each of the hinge modules 40 may include an upper hinge 41 and a lower hinge 43.

The main body 10 may include an inner case 11 forming the storage compartment 20 and an outer case 13 forming the exterior. An insulating material 15 may be foamed between the inner case 11 and the outer case 13 to minimize or prevent cold air of the storage compartment 20 from being discharged or escaping the storage compartment 20.

In addition, the main body 10 may include a partition 17 which partitions the storage compartment 20 into a refrigerator compartment 21 and a freezer compartment 23. The refrigerator compartment 21 and the freezer compartment 23 may be respectively formed at left and right sides in the storage compartment 20, but the positions of the refrigerator compartment 21 and the freezer compartment 23 are not limited thereto. A machine compartment 29, in which a compressor 51 to compress a refrigerant and a condenser (not shown) to condense the compressed refrigerant are installed, may be provided at a lower back side of the main body 10.

The refrigerator 1 may further include at least one shelf 25 and at least one storage member 100 provided inside the storage compartment 20 to store food and the like. The at least one storage member 100 may be opened or closed in connection with user operation of handle 140 and/or cover handle 220 of a storage member cover 200 (refer to FIG. 4).

The storage compartment 20 may be accessed by a user by opening or closing the door 30 that is pivotably coupled to the main body 10. In addition, the refrigerator compartment 21 and the freezer compartment 23 partitioned by the partition 17 may be respectively opened or closed by a refrigerator compartment door 31 and a freezer compartment door 33.

The refrigerator compartment door 31 and the freezer compartment door 33 may be pivotably coupled to the main body 10 by the hinge modules 40 including the upper hinges 41 provided at an upper portion of the main body 10 and the lower hinges 43 provided at a lower portion of the main body 10.

At least one door shelf 35 may be provided at a rear side (or inside) of the refrigerator compartment door 31 and the freezer compartment door 33 to store food and the like.

The refrigerator 1 may further include a cold air supply unit provided to supply cold air to the storage compartment 20. The cold air supply unit may include the compressor 51, the condenser (not shown), an evaporator 53, a blower fan 55, and a cold air duct 57. The compressor 51 and the condenser (not shown) may be installed in the machine compartment 29. The evaporator 53, the blower fan 55, and the cold air duct 57 may be installed at a rear side of the storage compartment 20.

Figure 3:
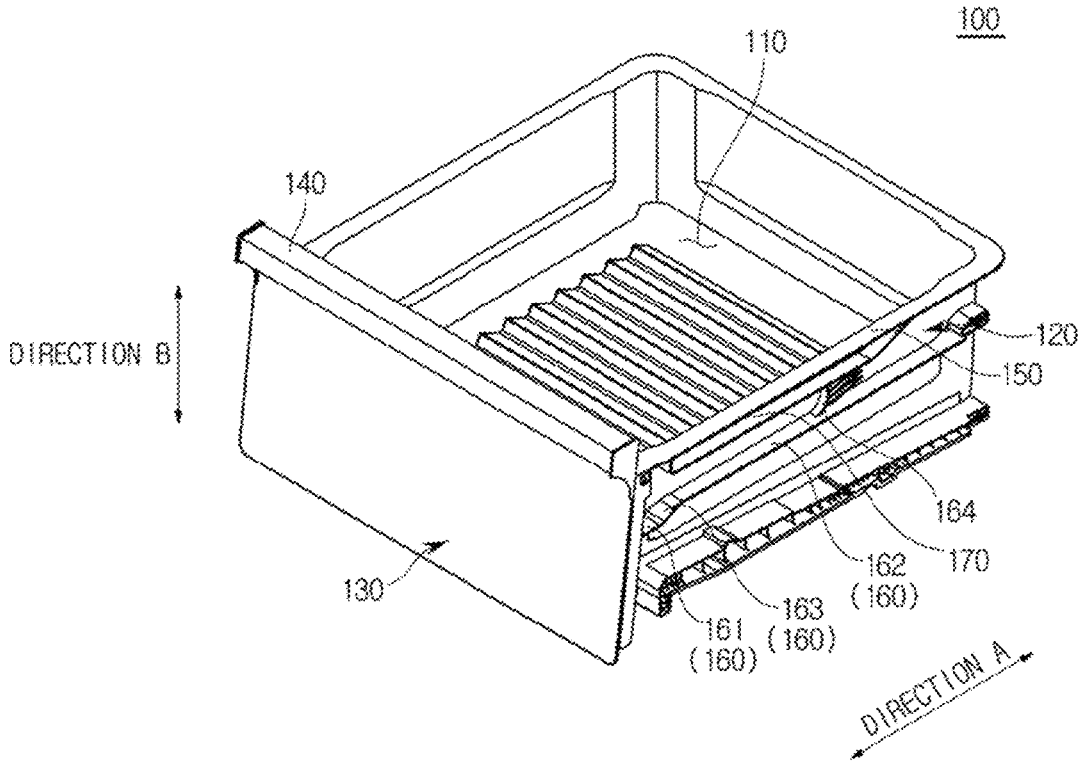
FIG. 3 is a perspective view illustrating a storage member of the refrigerator according to one embodiment of the present invention.

FIG. 3 is a perspective view illustrating a storage member of refrigerator 1 according to one embodiment of the present invention. Hereinafter, reference numerals which are not shown are referred to FIGS. 1 and 2.

As illustrated in FIG. 3, the refrigerator 1 may further include the at least one storage member 100. The at least one storage member 100 may be provided inside the storage compartment 20 and may be put into or taken out of the storage compartment 20. Specifically, the at least one storage member 100 may be provided inside the storage compartment 20 to be put into or taken out toward a front of the storage compartment 20.

A storage space 110 may be formed to store food inside the at least one storage member 100. The at least one storage member 100 may include a casing 120 to form an exterior. The storage space 110 may be formed inside the casing 120. The casing 120 may have an opened side. Specifically, a front side and an upper side of the casing 120 may be opened.

The at least one storage member 100 may further include a front panel 130, along with the casing 120, forming the exterior of the at least one storage member 100. The front panel 130 may be coupled to the opened front side of the casing 120. A handle 140 may be provided on the front panel 130 so that a user easily withdraws the at least one storage member 100 from the storage compartment 20. The handle 140 may be provided on the front panel 130 so that a user easily holds it. Specifically, the handle 140 may be provided on the front panel 130 to protrude toward the front of the storage compartment 20. However, a shape of the handle 140 is not limited to the above example, and may be changed variously.

At least one of the front panel 130 and the casing 120 may be formed of a transparent material. A transparent material may allow a user may confirm a food storage state in the storage space 110 from an outside thereof.

The exterior of the at least one storage member 100 may be formed by coupling the casing 120 and the front panel 130. Alternatively, the exterior of the at least one storage member 100 is formed by the casing 120 and the front panel 130 which are integrally formed.

The at least one storage member 100 may further include a contact surface 150. The contact surface 150 may be formed at an opened upper side of the at least one storage member 100. Specifically, the contact surface 150 may be formed along an edge of the upper side of the at least one storage member 100.

In another aspect, the contact surface 150 may be formed on the at least one storage member 100 to face the storage member cover 200. When the storage member cover 200 seals the storage space 110 of the at least one storage member 100, the storage member cover 200 may be in contact with or adhere to the contact surface 150. Alternatively, when a sealing member 260 (refer to FIG. 5) seals the storage space 110 of the at least one storage member 100, the sealing member 260 may be in contact with or adhere to the contact surface 150.

Figure 4:
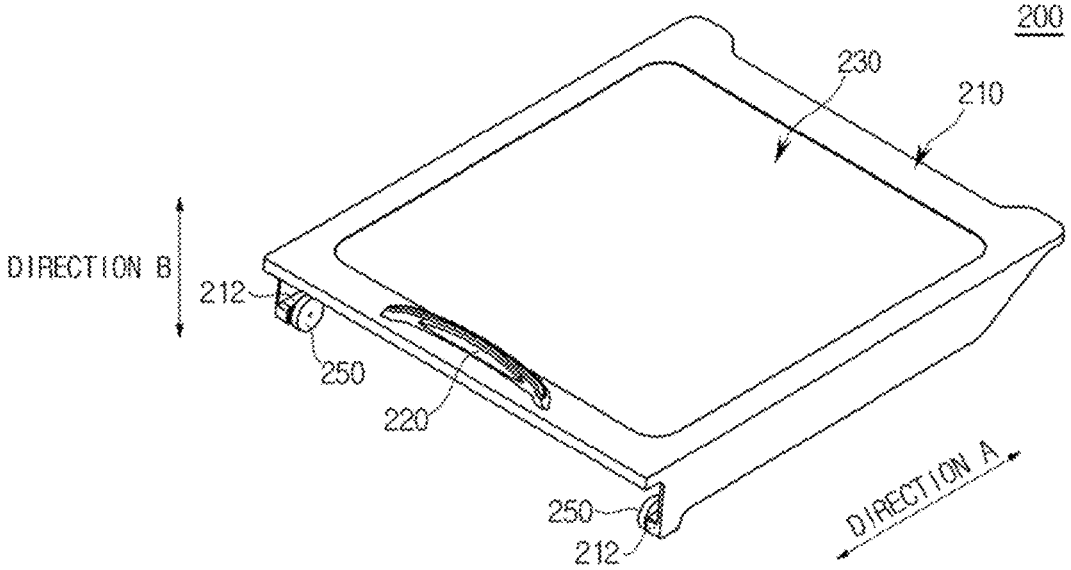
FIG. 4 is a perspective view illustrating a storage member cover of the refrigerator seen from one side, according to one embodiment of the present invention.

The refrigerator 1 may further include rails 160 to guide movement of the storage member cover 200 (refer to FIG. 4). The rail 160 may be provided on a side surface of the at least one storage member 100 to extend in a front and rear 'Direction A' of the storage compartment 20. The rail 160 may be provided on an outer surface of the at least one storage member 100 or an inner surface of the storage compartment 20. It is preferable that the rail 160 may be provided on the outer surface of the at least one storage member 100. When it is required that the storage member cover 200 moves in the 'Direction A' of the front and rear of the storage compartment 20 along the rail 160 provided on the outer surface of the at least one storage member 100, the storage member cover 200 has a structure which may completely cover the storage space 110 of the at least one storage member 100. Thus, it is effective to maintain the storage space 110 of the at least one storage member 100 in a sealed state.

The rail 160 may be integrally formed with the at least one storage member 100. That is, the rail 160 may be integrally formed with the at least one storage member 100 to be positioned at the side surface of the at least one storage member 100.

The rail 160 may have a step to adjust a sealed state of the storage space 110 of the at least one storage member 100 according to the movement of the storage member cover 200.

In addition, the rail 160 may have a slope to adjust a sealed state of the storage space 110 of the at least one storage member 100 according to the movement of the storage member cover 200.

The rail 160 may include a first section 161 and a second section 162.

The first section 161 may be provided on the side surface of the at least one storage member 100 toward the front of the storage compartment 20. The second section 162 may be provided on the side surface of the at least one storage member 100 toward a rear of the storage compartment 20. The second section 162 may be connected to the first section 161. The first section 161 and the second section 162 may be disposed at different levels in a coupling direction 'B' of the storage member cover 200. Specifically, the second section 162 may be disposed at an upper level than the first section 161 in the coupling direction 'B' of the storage member cover 200.

A stopper 164 may be provided at the second section 162 to restrict the movement of the storage member cover 200. Specifically, the stopper 164 may be provided at the second section 162 to restrict movement of a roller 250 (refer to FIG. 4). The stopper 164 may be provided to restrict the movement of the storage member cover 200, and also to prevent the storage member cover 200 from being tilted toward the rear of the storage compartment 20 while the storage member cover 200 moves toward the rear of the storage compartment 20.

The stopper 164 may have a shape protruding from the rail 160. Specifically, the stopper 164 may have a shape protruding upward from the second section 162 in the coupling direction B' of the storage member cover 200.

Alternatively, the stopper 164 may have a shape recessed from the rail 160. Specifically, the stopper 164 may have a shape recessed downward from the second section 162 in the coupling direction 'B' of the storage member cover 200.

Alternatively, the stopper 164 may have a shape which connects the rail 160 and a guide rail 170. Specifically, the stopper 164 may have a shape which connects the rail 160 and the guide rail 170 in the coupling direction 'B' of the storage member cover 200. At this time, the stopper 164 may have a curved surface to correspond to a shape of the roller 250 coupled to the storage member cover 200. Specifically, the stopper 164 may have a curved surface convex toward the rear of the storage compartment 20.

The rail 160 may further include a slope section 163. The slope section 163 may connect the first section 161 and the second section 162. That is, the slope section 163 may connect the first section 161 positioned at a lower level in the coupling direction 'B' of the storage member cover 200 and the second section 162 positioned at an upper level in the coupling direction 'B' of the storage member cover 200. The slope section 163 may have a shape tilted toward the rear of the storage compartment 20 based on the coupling direction 'B' of the storage member cover 200.

The refrigerator 1 may further include the guide rail 170, along with the rail 160, which guides the movement of the storage member cover 200. The guide rail 170, along with the rail 160, may guide the movement of the roller 250 coupled to the storage member cover 200.

The guide rail 170 may be disposed to be spaced apart from the rail 160. The guide rail 170 may be disposed to be spaced apart from the rail 160 in the coupling direction 'B' of the storage member cover 200.

The guide rail 170 may be provided on the side surface of the at least one storage member 100 to extend in the direction 'A' of the front and rear of the storage compartment 20. The guide rail 170, along with the rail 160, may be provided on the side surface of the at least one storage member 100. The guide rail 170 may be disposed at an upper level of the rail 160 in the coupling direction 'B' of the storage member cover 200.

The guide rail 170 may be disposed in parallel along with the rail 160. Specifically, the guide rail 170 may be disposed in parallel along with the second section 162 of the rail 160.

The rail 160 may extend more than the guide rail 170 toward the front of the storage compartment 20. In other words, the guide rail 170 may be disposed to face at least one of the slope section 163 and the second section 162. That is, the guide rail 170 may be disposed at an upper level of at least one of the slope section 163 and the second section 162 in the coupling direction 'B' of the storage member cover 200. It is preferable that the guide rail 170, along with the rail 160, be disposed at an upper level of the second section 162 to guide the movement of the roller 250 which moves in the direction 'A' of the front and rear of the storage compartment 20. In other words, when the guide rail 170 is positioned at an upper level of the first section 161 in the coupling direction 'B' of the storage member cover 200, the guide rail 170 may interfere or restrict the movement of the roller 250 which moves between the first section 161 and the second section 162. Thus, the guide rail 170 may be disposed at the upper level of the second section 162 in the coupling direction 'B' of the storage member cover 200.

The first section 161 of the rail 160 may allow the storage member cover 200 to seal the storage space 110 of the at least one of storage member 100. The second section 162 of the rail 160 may allow the storage member cover 200 to move in the direction 'A' of the front and rear of the storage compartment 20 to open or close the storage space 110 of the at least one storage member 100. The guide rail 170, along with the second section 162, may relate to that the storage member cover 200 moves in the direction 'A' of the front and rear of the storage compartment 20.

Figure 5:
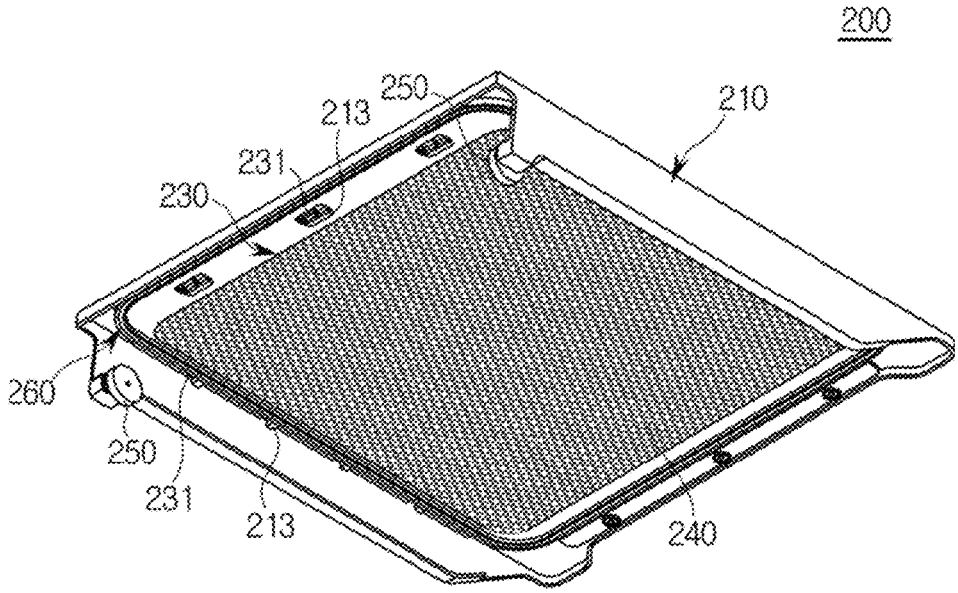
FIG. 5 is a perspective view illustrating the storage member cover of the refrigerator seen from another side, according to one embodiment of the present invention.
Figure 6:
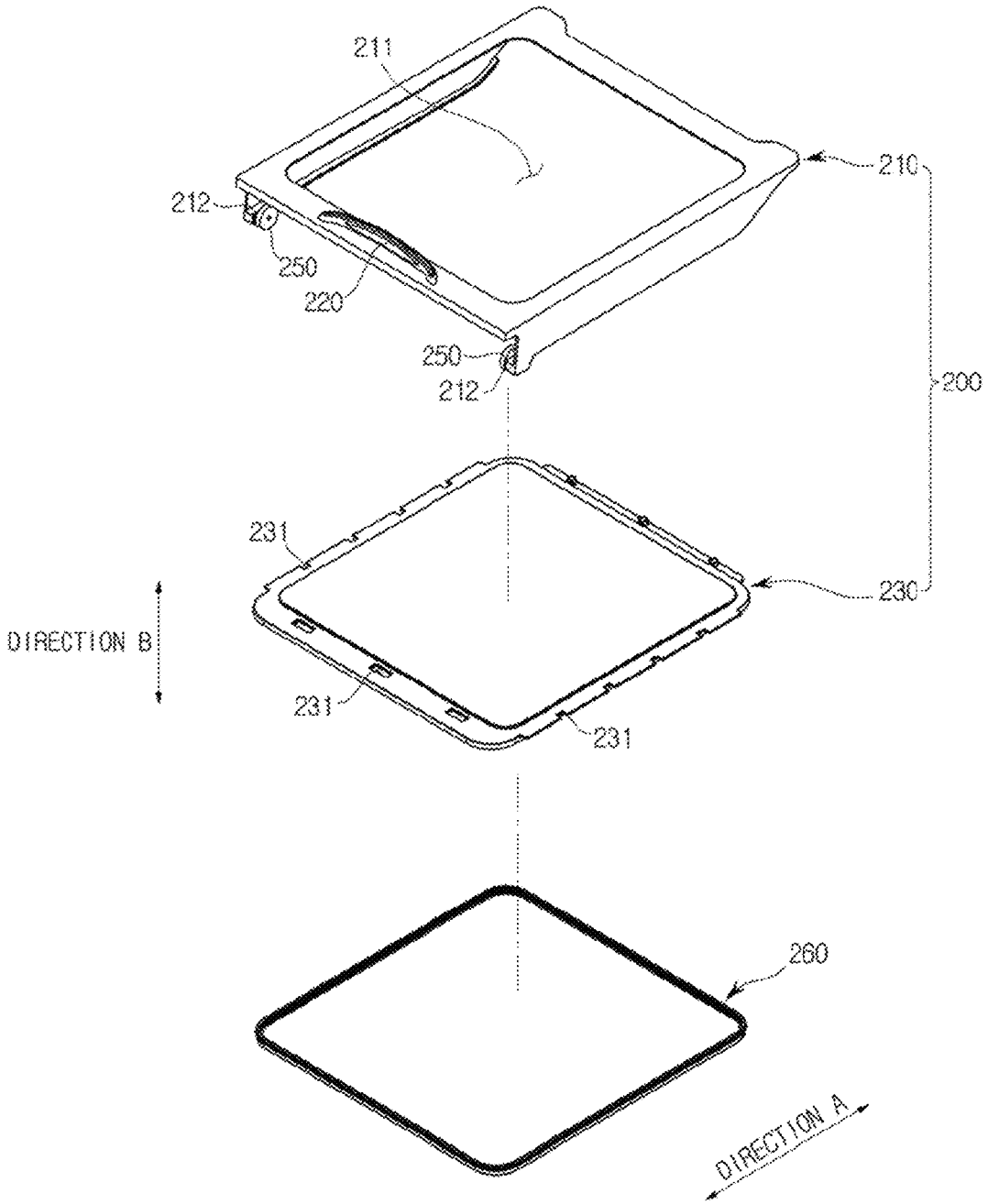
FIG. 6 is an exploded perspective view illustrating the storage member cover and a sealing member of the refrigerator according to one embodiment of the present invention.

FIG. 4 is a perspective view illustrating the storage member cover 200 of the refrigerator 1 seen from one side, according to one embodiment of the present invention. FIG. 5 is a perspective view illustrating the storage member cover 200 of the refrigerator 1 seen from another side, according to one embodiment of the present invention. FIG. 6 is an exploded perspective view illustrating the storage member cover 200 and a sealing member 260 of the refrigerator 1 according to one embodiment of the present invention. Hereinafter, for reference numerals which are not shown in FIGS. 4 to 6 refer to FIGS. 1 to 3.

As illustrated in FIGS. 4 to 6, the refrigerator 1 may further include the storage member cover 200. The refrigerator 1 may include a number of the storage member covers 200 corresponding in number to the at least one storage member 100. That is, refrigerator 1 may further include at least one storage member cover 200.

The storage member cover 200 may be coupled to the at least one storage member 100 to be able to selectively open and close the storage space 110 of the at least one storage member 100. Specifically, the storage member cover 200 may be coupled to a top surface of the opened casing 120 to be able to move along the rail 160.

The storage member cover 200 may include a frame 210. The frame 210 may form an exterior of the storage member cover 200. The frame 210 may include a frame opening 211. The frame opening 211 may be provided in a middle of a top surface of the frame 210.

In addition, the frame 210 may further include a roller coupling unit 212. The roller coupling unit 212 may be provided on a side surface of the frame 210. The roller coupling unit 212 may be provided to protrude downward from the side surface of the frame 210 in the coupling direction 'B' of the storage member cover 200. The roller coupling unit 212 may be provided at a front of the frame 210.

The frame 210 may include a plurality of fixtures 213. The plurality of fixtures 213 may be provided along a periphery of the frame opening 211. The plurality of fixtures 213 may be provided on one surface of the frame 210 which faces the storage space 110 of the at least one storage member 100. The plurality of fixtures 213 may couple to a plurality of fixing holes 231 formed at a panel 230.

The storage member cover 200 may further include a cover handle 220. The cover handle 220 may be provided on the storage member cover 200 so that a user may open or close the storage space 110 of the at least one storage member 100. Specifically, the cover handle 220 may be provided on the frame 210 of the storage member cover 200 to protrude upward in the coupling direction 'B' of the storage member cover 200. The cover handle 220 may be provided at a front of the storage member cover 200. That is, the cover handle 220 may be provided at a front of the frame 210. The cover handle 220 may be integrally formed with the storage member cover 200. That is, the cover handle 220 may be integrally formed with the frame 210.

The storage member cover 200 may further include the panel 230. The panel 230 may be coupled to the frame 210. Specifically, the panel 230 may be coupled to the frame 210 so that a part of the panel 230 is exposed to an outside thereof through the frame opening 211 of the frame 210. The panel 230 may be coupled to a bottom of the frame 210 in the coupling direction 'B' of the storage member cover 200.

As illustrated in FIG. 5, a water trapping pattern 240 may be formed at the panel 230. Specifically, the water trapping pattern 240 may be formed on a surface of the panel 230 facing the storage space 110 of the at least one storage member 100. The water trapping pattern 240 may be described below in detail.

The plurality of fixing holes 231 may be formed in the panel 230. The plurality of fixing holes 231 may be formed along a circumference of the water trapping pattern 240. The panel 230 may be coupled to the frame 210 by the plurality of fixtures 213 of the frame 210 being inserted into the plurality of fixing holes 231 of the panel 230.

A sealing member coupling portion 232 may be formed on the panel 230. The sealing member coupling portion 232 may be formed along a circumference of the water trapping pattern 240. The sealing member coupling portion 232 may be formed between the water trapping pattern 240 and the plurality of fixing holes 231. The sealing member coupling portion 232 may have a recessed shape.

It is possible that the frame 210 and the panel 230 are integrally formed. The roller 250 which moves along the rail 160 may be coupled to the storage member cover 200. The roller 250 may be rotatably coupled to the roller coupling unit 212 of the frame 210. The storage member cover 200 may move in the direction 'A' of the front and rear of the storage compartment 20 according to the movement of the roller 250 along the rail 160.

The refrigerator 1 may further include the sealing member 260. Fruits or vegetables retaining lots of moisture may be stored or kept inside the storage space 110 of the at least one storage member 100. It is important to maintain humidity in the storage space 110 of the at least one storage member 100 in order to maintain freshness of the fruits or vegetables.

In order to maintain humidity in the storage space 110 of the at least one storage member 100, a sealing structure may be applied to the storage space 110 of the at least one storage member 100. The sealing structure of the storage space 110 of the at least one storage member 100 may be basically implemented by coupling of the at least one storage member 100 and the storage member cover 200. The sealing member 260 may be provided between the at least one storage member 100 and the storage member cover 200 to improve the sealability of the storage space 110 of the at least one storage member 100.

The sealing member 260 member may be coupled to the storage member cover 200. Specifically, the sealing member 260 may be coupled to the sealing member coupling portion 232 provided on the panel 230.

The sealing member 260 may formed of an elastic material. The sealing member 260 may include at least one material of a rubber and silicone. However, a material of the sealing member 260 is not limited to a rubber or silicone.

Figure 7:
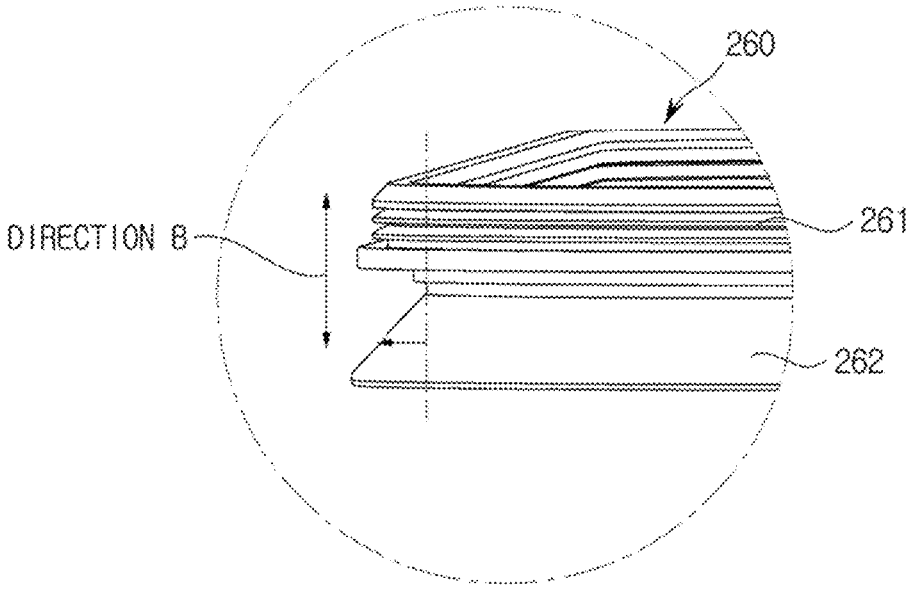
FIG. 7 is a perspective view illustrating the enlarged sealing member in FIG. 6.

A structure of the sealing member 260 will be described below in detail. FIG. 7 is a perspective view illustrating the enlarged sealing member in FIG. 6. Hereinafter, for reference numerals which are not shown in FIG. 7 refer to FIGS. 1 to 6.

As illustrated in FIG. 7, the sealing member 260 may include a pleat portion 261 and an adhesion portion 262. A plurality of pleats may be formed at the pleat portion 261. In addition, the pleat portion 261 may be coupled to the storage member cover 200. Specifically, the pleat portion 261 may be coupled to the sealing member coupling portion 232 provided on the panel 230.

The adhesion portion 262 may be connected to the pleat portion 261. In addition, the adhesion portion 262 may adhere to the at least one storage member 100 so that the adhesion portion 262 may be separated therefrom according to the movement of the storage member cover 200. Specifically, the adhesion portion 262 may adhere to the contact surface 150 of the at least one storage member 100 so that the adhesion portion 262 may be separated from the contact surface 150 according to the movement of the storage member cover 200 which moves along the rail 160 in the direction 'A' of the front and rear of the storage compartment 20. The adhesion portion 262 may be connected to the pleat portion 261 so that the adhesion portion 262 is inclined in a direction of an outside of the sealing member 260 with respect to the coupling direction 'B' of the storage member cover 200.

Figure 8:
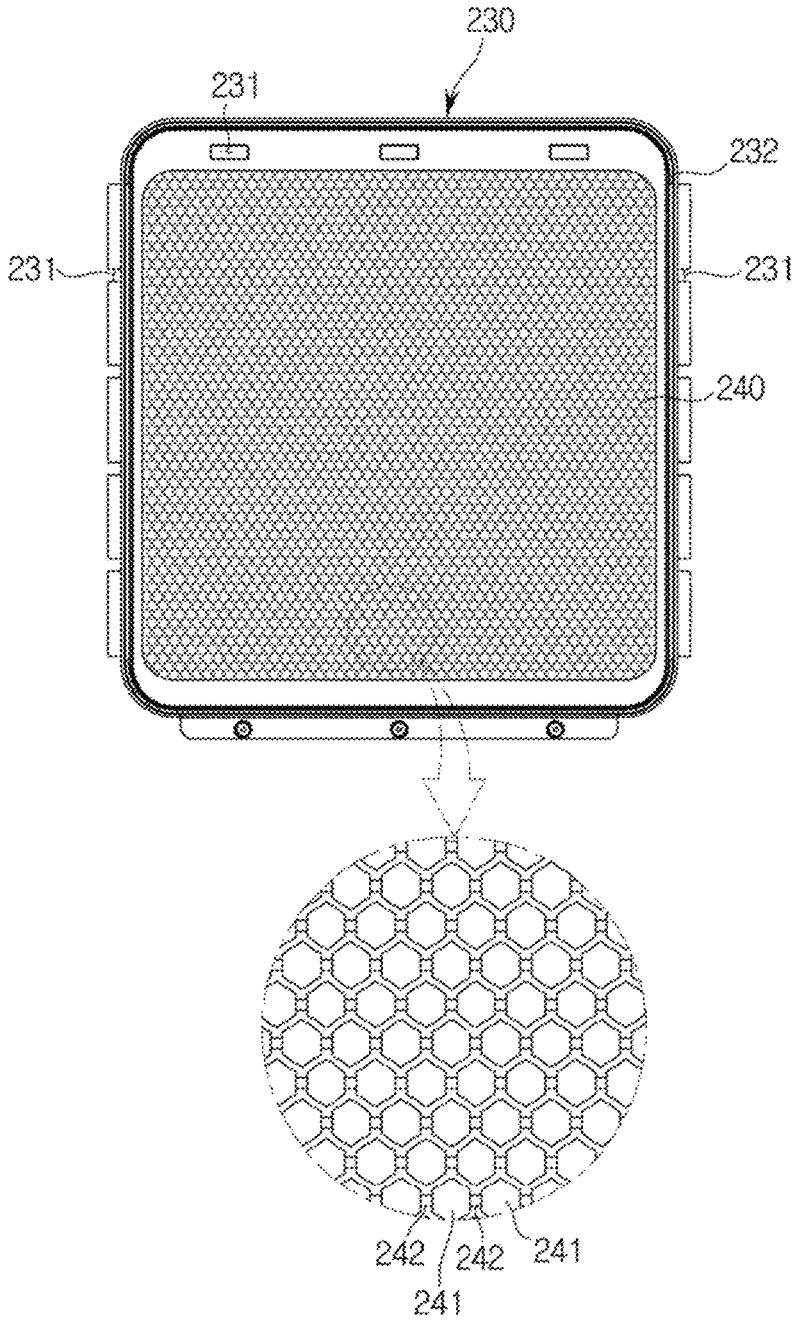
FIG. 8 is a bottom view illustrating a panel included in the storage member cover of the refrigerator according to one embodiment of the present invention.
Figure 9:
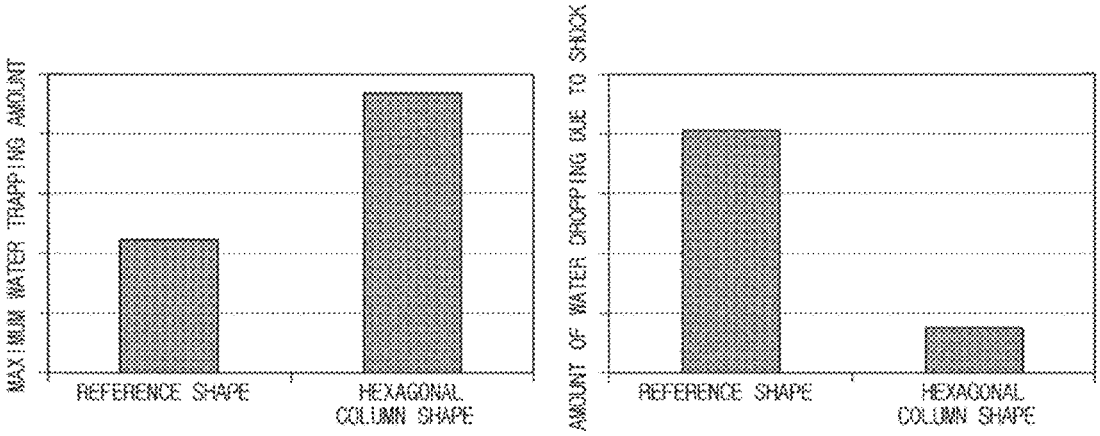
FIG. 9 is a view showing graphs which compare water trappability according to various patterns formed in a panel which is included in the storage member cover of the refrigerator according to one embodiment of the present invention.

FIG. 8 is a bottom view illustrating a panel 230 included in the storage member cover 200 of the refrigerator 1 according to one embodiment of the present invention. FIG. 9 is a view showing graphs which compare water trappability according to various patterns formed in the panel which is included in the storage member cover of the refrigerator according to one embodiment of the present invention. Hereinafter, for reference numerals which are not shown in FIGS. 8 and 9 refer to FIGS. 1 to 7. In addition, since the panel 230 was already described through the FIGS. 4 to 6, hereinafter, the water trapping pattern 240 will be mainly described.

As illustrated in FIG. 8, the water trapping pattern 240 may be formed on a surface of the storage member cover 200 facing the storage space 110 of the at least one storage member 100. That is, the water trapping pattern 240 may be formed on a surface of the panel 230 facing the storage space 110 of the at least one storage member 100.

When the storage space 110 of the at least one storage member 100 has a sealing structure, water drops may be formed on the storage member cover 200. That is, the water drops may be formed on the storage member cover 200 due to dew condensation phenomena. As the water drops formed on the storage member cover 200 become bigger, the water drops may drop into the storage space 110 of the at least one storage member 100 due to gravity. At this time, vegetables or fruits stored in the storage space 110 of the at least one storage member 100 may turn mushy due to water drops dropped from the storage member cover 200. The water trapping pattern 240 may be formed on the storage member cover 200 so that vegetables and fruits stored in the storage space 110 of the at least one storage member 100 are prevented from turning mushy by water drops formed on the storage member cover 200 as described above.

The water trapping pattern 240 may have a shape recessed upward in the coupling direction 'B' of the storage member cover 200 (refer to FIG. 5). The water trapping pattern 240 may include a plurality of water trapping portions 241. The plurality of water trapping portions 241 may be disposed to be spaced apart from each other. That is, the plurality of water trapping portions 241 may be disposed to be spaced apart from each other to prevent moisture (water drops) trapped in the plurality of water trapping portions 241 from being combined.

The plurality of water trapping portions 241 may have a column shape. The plurality of water trapping portions 241 may have the column shape having a polygonal or circular section. In one embodiment, it is preferable that the plurality of water trapping portions 241 have a hexagonal column shape recessed upward in the coupling direction 'B' of the storage member cover 200. As shown from graphs in FIG. 9, the hexagonal column shape may maximize the maximum amount of water to be trapped in the plurality of water trapping portions 241 than a reference shape. In addition, the hexagonal column shape stands to have much less amount of moisture (water drops) to be dropped out of the plurality of water trapping portions 241 due to a shock than the reference shape. The reference shape may have a quadrangular pyramid shape.

The results of the experiment illustrated in FIG. 9 may be described using a contact area or surface tension between the plurality of water trapping portions 241 and moisture (water drops) trapped in the plurality of water trapping portions 241. That is, when the plurality of water trapping portions 241 has the hexagonal column shape, since a contact area between the plurality of water trapping portions 241 and moisture (water drops) trapped in the plurality of water trapping portions 241. In other words, a water tension between the plurality of water trapping portions 241 and moisture (water drops) trapped in the plurality of water trapping portions 241 is greater, the water trappability of the plurality of water trapping portions 241 is excellent.

Widths of the plurality of water trapping portions 241 may decrease upward in the coupling direction 'B' of the storage member cover 200. However, it is possible that a width of the plurality of water trapping portions 241 maintains constant in the coupling direction 'B' of the storage member cover 200.

In another aspect, a surface of the plurality of water trapping portions 241 facing the storage space 110 of the at least one storage member 100 may be formed in a hexagonal shape to have a wide contact area with moisture (water drops) trapped or collected in the plurality of water trapping portions 241.

The water trapping pattern 240 may further include bridges 242.

The bridges 242 may connect the plurality of water trapping portions 241 each other. In addition, the bridges 242 may have narrower widths than the plurality of water trapping portions 241 to prevent moisture (water drops) trapped or collected in the plurality of water trapping portions 241 from being combined.

Each of the bridges 242 may have a square column shape, but the shape of the bridge 242 is not limited thereto. In addition, the bridge 242 may have a shape recessed upward in the coupling direction 'B' of the storage member cover 200. Recessed degrees of the plurality of water trapping portions 241 and the bridges 242 may be different from each other. It is preferable that recessed degrees of the plurality of water trapping portions 241 be greater than that of the bridges 242.

Figure 10:
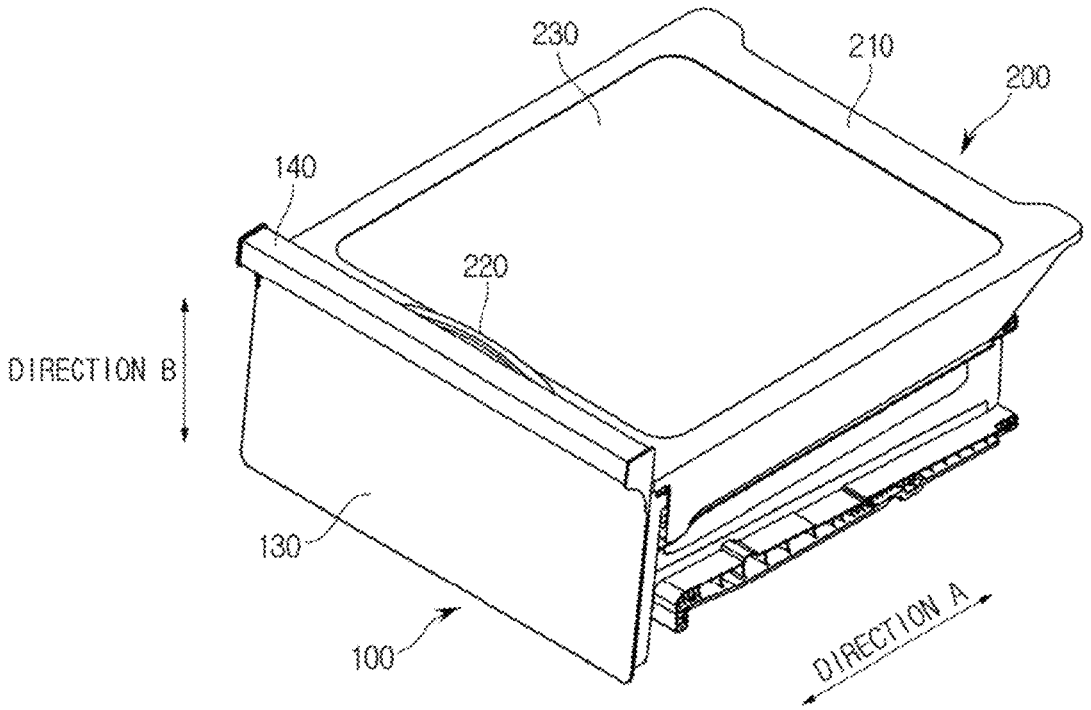
FIG. 10 is a perspective view illustrating a state in which the storage member cover of the refrigerator according to one embodiment of the present invention is closed.
Figure 11:
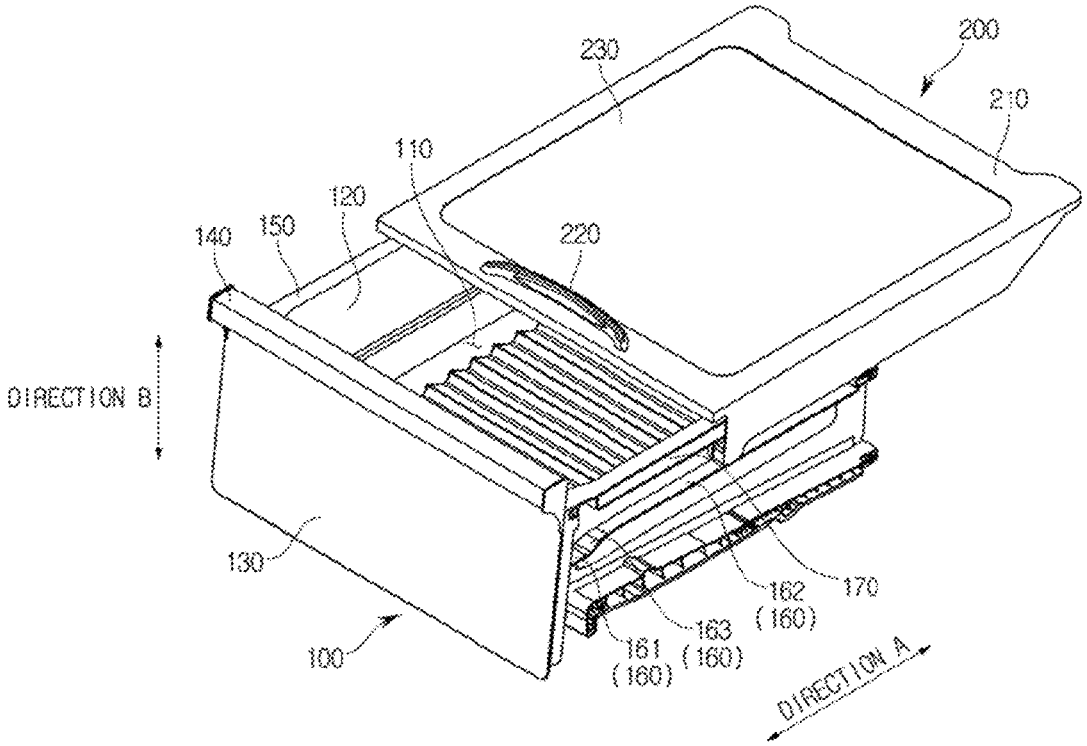
FIG. 11 is a perspective view illustrating a state in which the storage member cover of the refrigerator according to one embodiment of the present invention is opened.

FIG. 10 is a perspective view illustrating a state in which the storage member cover 200 of the refrigerator 1 according to one embodiment of the present invention is closed. FIG. 11 is a perspective view illustrating a state in which the storage member cover 200 of the refrigerator 1 according to one embodiment of the present invention is opened. Hereinafter, reference numerals which are not shown are referred to FIGS. 1 to 9.

As illustrated in FIGS. 10 and 11, the storage member cover 200 may move in the direction 'A' of the front and rear of the storage compartment 20 according to the movement of the roller 250 along the rail 160. When the storage member cover 200 moves toward the front of the storage compartment 20, the storage space 110 of the at least one storage member 100 is in a closed state. When the storage member cover 200 moves toward the rear of the storage compartment 20, the storage space 110 of the at least one storage member 100 is in an opened state.

When the roller 250 is positioned at first section 161 of the rail 160, the storage member cover 200 may adhere to the at least one storage member 100 to seal the storage space 110 of the at least one storage member 100. In other words, when the roller 250 is positioned at the first section 161 of the rail 160, the sealing member 260 may adhere to the at least one storage member 100 downward in the coupling direction 'B' of the storage member cover 200 to seal the storage space 110 of the at least one storage member 100. That is, when the roller 250 is positioned at the first section 161 of the rail 160, the storage member cover 200 or the sealing member 260 may adhere to the contact surface 150 of the at least one storage member 100. When the roller 250 is positioned at the first section 161 of the rail 160, the storage space 110 of the at least one storage member 100 maintains a closed state, specifically, a sealed state.

When the roller 250 is positioned at the second section 162 of the rail 160, the storage member cover 200 may be spaced apart from the at least one storage member 100 so that the storage space 110 of the at least one storage member 100 is opened. In other words, the sealing member 260 may be spaced apart from the at least one storage member 100 upward in the coupling direction 'B' of the storage member cover 200 to prevent from being abraded by contact with the at least one storage member 100 while the roller 250 moves along the second section 162 of the rail 160. That is, when the roller 250 is positioned at the second section 162 of the rail 160, the storage member cover 200 or the sealing member 260 may be spaced apart from the contact surface 150 of the at least one storage member 100. When the roller 250 is positioned at the second section 162 of the rail 160, the storage space 110 of the at least one storage member 100 maintains an opened state.

Opening and closing processes of the storage space 110 of the at least one storage member 100 will be briefly described as below. When a user pulls the handle 140 toward a front of the storage compartment 20, the at least one storage member 100 and the storage member cover 200 are drawn together. After that, the user moves the storage member cover 200 up in the coupling direction 'B' of the storage member cover 200, and the user pushes the storage member cover 200 toward the rear of the storage compartment 20. The user takes desired vegetables or fruits out of the opened storage space 110 of the at least one storage member 100. After that, when the user pushes the at least one storage member 100 toward the rear of the storage compartment 20, the storage member cover 200 moves toward the front of the storage compartment 20 along the rail 160. The storage member cover 200 moves down in the coupling direction 'B' of the storage member cover 200 in the storage compartment 20 to seal the storage space 110 of the at least one storage member 100.

Figure 12:
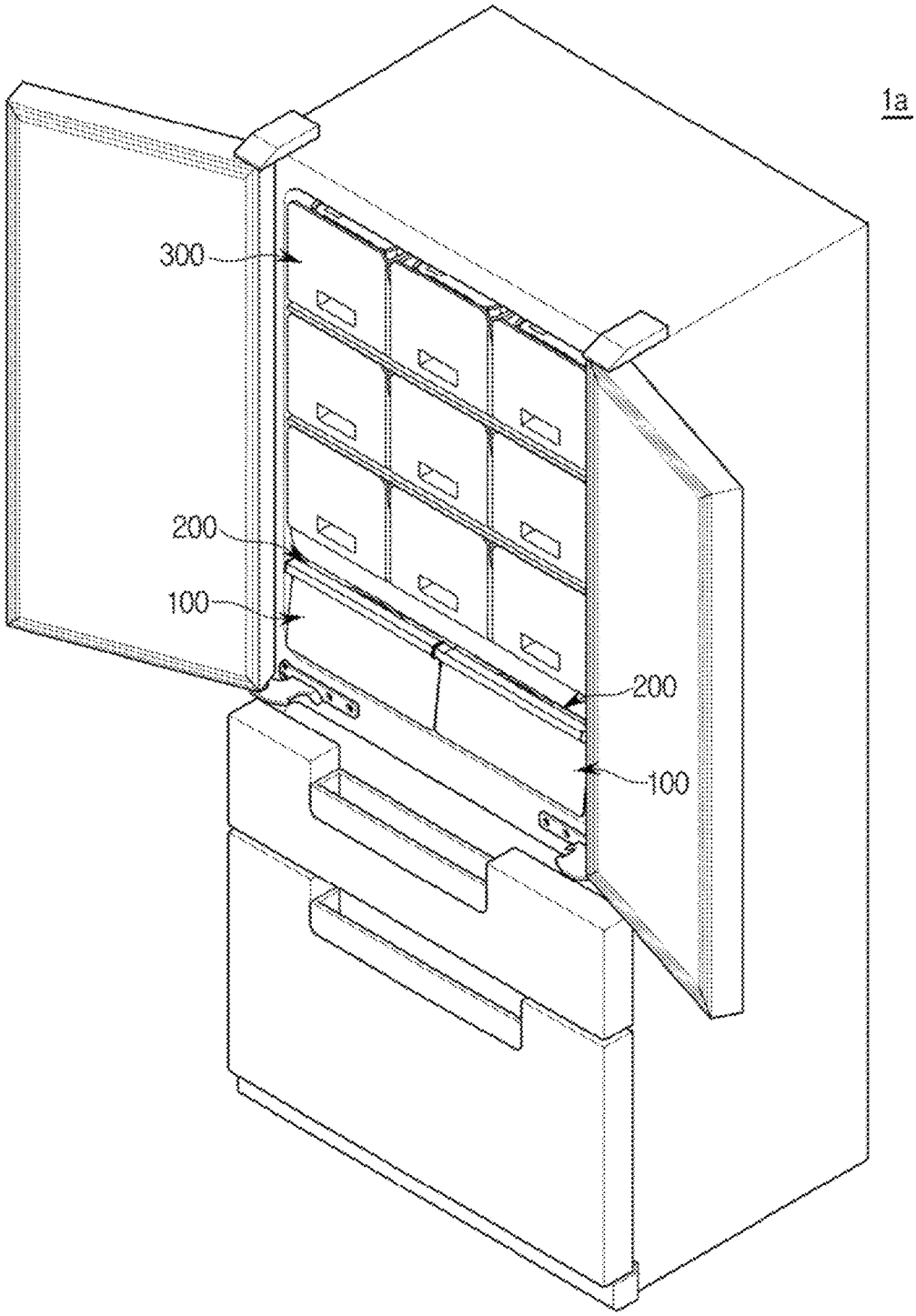
FIG. 12 is a perspective view illustrating a refrigerator according to another embodiment of the present invention.

FIG. 12 is a perspective view illustrating a refrigerator 1 according to another embodiment of the present invention.

Hereinafter, for reference numerals which are not shown in FIG. 12 refer to FIGS. 1 to 11. In addition, duplicated descriptions described in the FIGS. 1 to 11 will not be repeated.

As illustrated in FIG. 12, at least one storage member 100 and a storage member cover 200 according to another embodiment of the present invention may be also applied to a kimchi refrigerator 1*a* including a plurality of kimchi storage compartments 300.

The at least one storage member 100 and the storage member cover 200 according to another embodiment of the present invention may be applied to any type of refrigerators 1. As is apparent from the above description, in a refrigerator 1 in accordance with an embodiment of the present invention, a sealing member 260 is disposed between a storage member 100 and a storage member cover 200 to improve sealability of a storage space 110 of the storage member 100 and, in turn, maintain the humidity inside the storage space 110 of the storage member 100.

Since a storage member cover 200 is designed for a user to directly open or close the storage member cover 200, the user can use the storage member 100 and the storage member cover 200 in a state in which the user recognizes a sealing function of the storage member cover 200 for the storage member 100.

Since a rail 160 including a step or a slope is disposed, sealability of a storage space 110 of a storage member 100 can be controlled according to movement of a storage member cover 200, which moves along the rail 160.

Since rail 160 may include a step or a slope is disposed, the sealing member 260 can be prevented from being abraded or damaged due to contact with a storage member while a storage member cover moves along the rail. Since a water trapping pattern 240 capable of trapping water drops at a storage member cover 200 due to sealing of storage space 110 of storage member 100, the freshness of food stored in the storage space of the storage may be maintained.

Although the present invention has been described with reference to specific embodiments and drawings, the present invention is not limited thereto. It is apparent by those skilled in the art that various modifications and alternations may be made without departing from the spirit and scope of the present invention and equivalents of the appended claims.

What is claimed is:

1. A refrigerator comprising:

a storage compartment including a front side provided to be opened;

a storage member provided inside the storage compartment to be put into or taken out toward the front of the storage compartment, and defining a storage space;

a storage member cover coupled to the storage member to selectively open or close a storage space of the storage member;

a rail which guides movement of the storage member cover, and includes a step to control a sealing state of the storage space of the storage member according to the movement of the storage member cover; and a roller which moves along the rail is coupled to the storage member cover, wherein the rail includes:

a first section provided toward a front of the storage compartment; and a second section connected to the first section toward a rear of the storage compartment and positioned at a higher level than the first section, wherein the storage member cover contacts with the storage member to seal the storage space of the storage member when the roller is positioned at the first section.

2. The refrigerator of claim 1, further comprising a sealing member is provided between the storage member and the storage member cover to improve sealability of the storage space of the storage member.

3. The refrigerator of claim 2, wherein the sealing member is coupled to the storage member cover.

4. The refrigerator of claim 1, wherein the rail is provided on a side surface of the storage member to extend in a front and rear direction of the storage compartment.

5. The refrigerator of claim 1, wherein the storage member cover is spaced apart from the storage member to open the storage space of the storage member when the roller is positioned at the second section.

6. The refrigerator of claim 1, further comprising a sealing member is coupled to the storage member cover to improve sealability of the storage space of the storage member, wherein the sealing member adheres to the storage member downward in the coupling direction of the storage member cover to seal the storage space of the storage member when the roller is positioned at the first section.

7. The refrigerator of claim 6, wherein the sealing member is spaced apart from the storage member upward in the coupling direction of the storage member cover to prevent the sealing member from being abraded due to a contact with the storage member while the roller moves along the second section.

8. The refrigerator of claim 1, wherein a stopper is provided at the second section to restrict movement of the roller.

9. The refrigerator of claim 1, wherein the rail is integrally formed with the storage member to be positioned at a side surface of the storage member.

10. The refrigerator of claim 1, wherein a water trapping pattern is formed in a surface of the storage member cover facing the storage space of the storage member.

11. The refrigerator of claim 10, wherein the water trapping pattern has a shape recessed upward in a coupling direction of the storage member cover.

12. The refrigerator of claim 10, wherein the water trapping pattern includes a plurality of water trapping portions which are disposed to be spaced apart from each other and have a hexagonal column shape recessed upward in a coupling direction of the storage member cover.

13. A refrigerator comprising:

a storage compartment including a front side provided to be opened;

a storage member provided inside the storage compartment to be put into or taken out toward the front of the storage compartment;

a storage member cover coupled to the storage member to selectively open or close a storage space of the storage member;

a sealing member provided between the storage member and the storage member cover to improve sealability of the storage space of the storage member; and a rail which guides movement of the storage member cover, and includes a step to control a sealing state of the storage space of the storage member according to the movement of the storage member cover, wherein the sealing member includes a pleat portion having a plurality of pleats and coupled to the storage member cover; and an adhesion portion which is connected to the pleat portion and adheres to the storage member to be separable according to the movement of the storage member cover.

14. The refrigerator of claim 13, wherein the adhesion portion is connected to the pleat portion to be inclined toward an outside of the sealing member with respect to a coupling direction of the storage member cover.

15. A refrigerator comprising:

a storage compartment including a front side provided to be opened;

a storage member provided inside the storage compartment to be put into or taken out toward the front of the storage compartment;

a storage member cover coupled to the storage member to selectively open or close a storage space of the storage member, and including a water trapping pattern formed in a surface facing the storage space of the storage member;

a sealing member provided between the storage member and the storage member cover to improve sealability of the storage space of the storage member;

a rail which guides movement of the storage member cover, and includes a slope to control a sealing state of the storage space of the storage member according to the movement of the storage member cover; and wherein a roller which moves along the rail is coupled to the storage member cover, wherein the rail includes:

a first section provided toward a front of the storage compartment; and a second section connected to the first section toward a rear of the storage compartment and positioned at a higher level than the first section, wherein the sealing member is coupled to the storage member cover to face the storage space of the storage compartment, and the sealing member contacts with the storage member to seal the storage space of the storage member when the roller is positioned at the first section.

16. The refrigerator of claim 15, wherein the water trapping pattern has a shape recessed upward in a coupling direction of the storage member cover.

17. The refrigerator of claim 15, wherein the water trapping pattern includes a plurality of water trapping portions which are disposed to be spaced apart from each other.

18. The refrigerator of claim 17, wherein a surface of the plurality of water trapping portions facing the storage space of the storage member is formed in a hexagonal shape to have a wide contact area with water drops trapped in the plurality of water trapping portions.

19. The refrigerator of claim 17, wherein the water trapping pattern further includes bridges which connect the plurality of water trapping portions to each other and have a narrower width than the plurality of water trapping portions to prevent water drops trapped in the plurality of water trapping portions from being combined.

20. The refrigerator of claim 19, wherein recessed degrees of the plurality of water trapping portions and the bridges are different from each other.

21. The refrigerator of claim 15, wherein the sealing member is spaced apart from the storage member upward in the coupling direction of the storage member cover to prevent the sealing member from being abraded due to a contact with the storage member while the roller moves along the second section.

* * * * *